US006843715B2

(12) United States Patent
Munini

(10) Patent No.: US 6,843,715 B2
(45) Date of Patent: Jan. 18, 2005

(54) CONTAINER-DISPENSER FOR COINS

(75) Inventor: Dino Munini, San Quirino (IT)

(73) Assignee: Microstamp Srl, San Quirino (IT)

( * ) Notice: Subject to any disclaimer, the term of this patent is extended or adjusted under 35 U.S.C. 154(b) by 104 days.

(21) Appl. No.: 10/293,279

(22) Filed: Nov. 14, 2002

(65) Prior Publication Data

US 2003/0094345 A1 May 22, 2003

(30) Foreign Application Priority Data

Nov. 16, 2001 (IT) ..... UD2001A0183

(51) Int. Cl.[7] ..... G07D 1/08
(52) U.S. Cl. ..... 453/47
(58) Field of Search ..... 194/338; 453/39, 453/63, 43, 44, 45, 46, 47; 221/92, 185, 247, 270

(56) References Cited

U.S. PATENT DOCUMENTS 519,765 A * 5/1894 Goertz ..... 150/117
1,435,834 A 11/1922 Fuller
1,823,227 A * 9/1931 Maurice ..... 453/44
3,731,695 A 5/1973 Meijer
4,540,008 A * 9/1985 Murphy ..... 453/18
5,492,504 A * 2/1996 Wolters ..... 453/54
6,062,420 A 5/2000 Krouwel et al.

FOREIGN PATENT DOCUMENTS

| | | | |
|---|---|---|---|
| AT | 111675 | 12/1928 | |
| DE | 3922763 | 1/1991 | |
| EP | 1.283.504 A2 * | 2/2003 | ..... G07D/0/99 |
| WO | 0009419 | 2/2000 | |

* cited by examiner

*Primary Examiner*—Donald P. Walsh
*Assistant Examiner*—Mark J. Beauchaine
(74) *Attorney, Agent, or Firm*—Stevens, Davis, Miller & Mosher, LLP

(57) ABSTRACT

Container-dispenser (10) for coins (20) comprising housing seatings (19) able to accommodate coins (20) of a defined value, the base (11) being associated with expulsion means (26) able to be selectively positioned in correspondence with one of the housing seatings (19) at a time to push and expel a relative coin (20). The housing seatings (19) are defined by dividing walls (15) including elastic appendixes (16) cooperating with the perimeter of the coins (20), to hold them in the housing seatings (19), which temporarily deform when the coins (20) are pushed by the expulsion means (26), to allow them to exit from the relative housing seating (19).

17 Claims, 4 Drawing Sheets

CONTAINER-DISPENSER FOR COINS

FIELD OF THE INVENTION

The invention refers to a container-dispenser for coins which permits the differentiated accommodation of a plurality of coins grouped together according to their different value, allowing them to be selectively extracted quickly and simply.

BACKGROUND OF THE INVENTION

The state of the art includes wallets equipped with an appropriate compartment to contain coins and traditional purses in which the coins are kept haphazardly.

However, when using such wallets and purses there is often the problem of recognizing and finding the coins quickly, since the user has to look for the individual coin to be used for payment among all the other coins which are mixed with it, which entails a waste of time and various difficulties; moreover, especially in the case of a considerable quantity of coins, there is the difficulty of verifying immediately if the coin required is there or not.

These disadvantages are more of a problem when there are a lot of coins, of different values but similar in size and in the writing impressed thereon, or when one is in a foreign country with coins one is not used to using.

U.S. Pat. No. 6,062,420 describes a pocket device to contain and distribute pills, wherein the pills are housed in relative seatings arranged radially with respect to a circular base and cover. There is also an expulsion device which rotates with respect to the base and cover and is equipped with elastic means to expel the pill selected on each occasion.

However, the device described in U.S. Pat. No. '420 is not suitable to contain, and facilitate finding and removing, a plurality of coins divided according to value and piled up in the relative seatings.

The present Applicant has devised ad embodied this invention to overcome the shortcomings of the state of the art and to obtain further advantages.

SUMMARY OF THE INVENTION

The invention is set forth and characterized essentially in the main claim, while the dependent claims describe other innovative characteristics of the invention.

The purpose of the invention is to achieve a container-dispenser which is simple, economical, compact and can be carried in the pocket, which will allow to keep the coins in an orderly and differentiated manner according to their value, facilitating the user in recognizing them, finding them and selectively extracting them when needed for use.

In accordance with this purpose, the container-dispenser according to the invention comprises at least a base and a lid associated therewith, between which there are a plurality of housing seatings each one suitable to accommodate a plurality of coins with a specific value.

The base is associated with knob means provided with expulsion means able to be positioned selectively in correspondence with one housing seating at a time to expel the coins contained therein one at a time to the outside.

In a preferential embodiment, the coins are stacked up one on top of the other in the relative housing seatings and the expulsion means consist of a tongue able to act on the coin located at the bottom of the pile.

According to a variant, the lid, of a conformation mating with that of the base and provided with an aperture to access the knob means, has indications of the value of the coins contained in the housing seatings below.

In a preferential embodiment, the indications consist of embossed numerical characters of a traditional kind.

According to a variant, the embossed numerical characters are in Braille or similar, to allow the container-dispenser according to the invention to be used by the visually impaired.

In a preferential form of embodiment, the base comprises a substantially flat element, for example circular in shape, associated with a plurality of dividing walls which together therewith define the housing seatings for the coins.

The dividing walls have respective elastic appendices which cooperate with the perimeter of the coins to hold them inside the housing seatings; moreover, the elastic appendices deform when the expulsion means thrust the coins, so as to allow them to emerge from the relative housing seatings.

In one embodiment of the invention, the housing seatings are made in a circle around the knob means which are constrained to a pin integral, or made in a single piece, with the base.

With respect to the pin, the knob means can rotate, to position themselves in correspondence with the desired housing seating, and also translate to move from a retracted position, wherein the expulsion means do not interfere with the housing seatings, to a second advanced position, wherein the expulsion means move at least partly inside the housing seating to expel the desired coin.

In order to extract a coin, once he has identified the housing seating of the coin, the user only has to position the knob means in correspondence with said seating and then move them to the advanced position so that the expulsion means thrust the desired coin outside the relative housing seating.

By means of the container-dispenser according to the invention, no time is wasted looking for the necessary coins. Moreover, the coins are always kept in an orderly fashion differentiated according to their value, thus allowing the user to verify immediately whether the coins are available in his possession.

DESCRIPTION OF THE DRAWINGS

These and other characteristics of the invention will be apparent from the following description of a preferential form of embodiment, given as a non-restrictive example, with reference to the attached drawings wherein.

DETAILED DESCRIPTION OF A PREFERENTIAL FORM OF EMBODIMENT OF THE INVENTION

Figure 1:
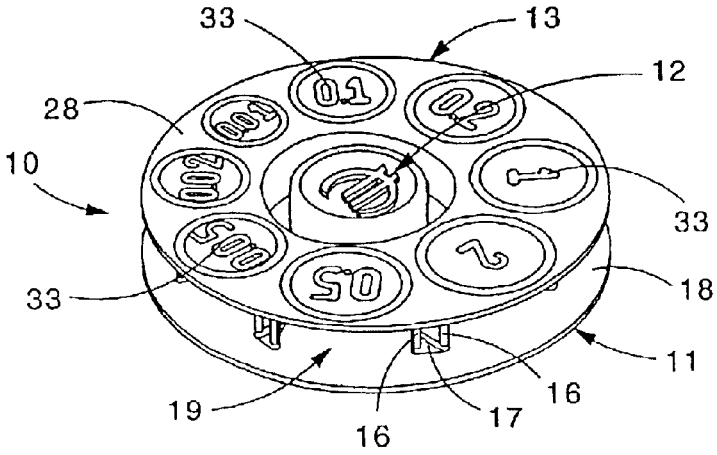
FIG. 1 is an axonometric projection of a container-dispenser for coins according to the invention.
Figure 2:
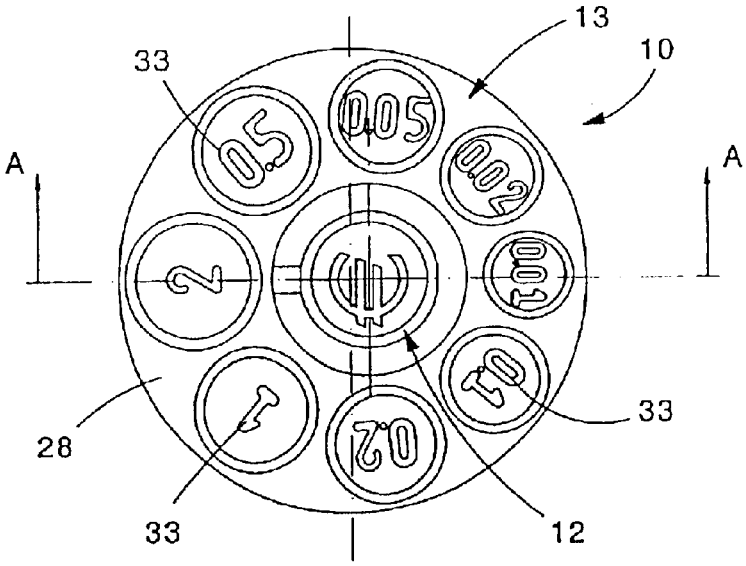
FIG. 2 is a view from above of FIG. 1.
Figure 3:
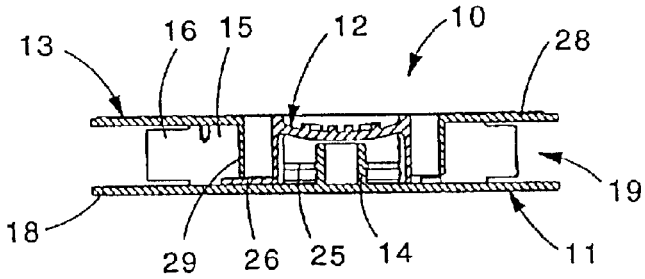
FIG. 3 shows a section from A to A of FIG. 2.

With reference to the attached drawings, a container-dispenser 10 for coins 20 according to the invention is advantageously of the type which can be carried in the pocket and comprises a base 11, a knob 12 and a lid 13 (FIG. 1.

Figure 4:
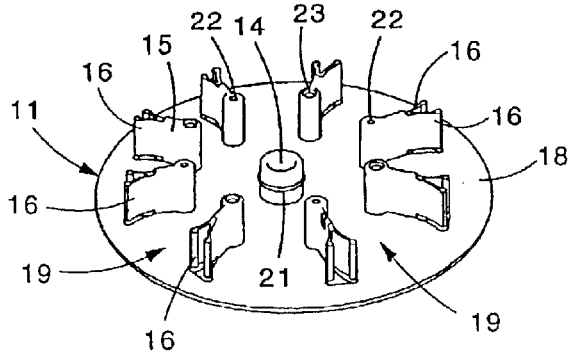
FIG. 4 is an axonometric projection of a first component of the container-dispenser shown in FIG. 1.
Figure 5:
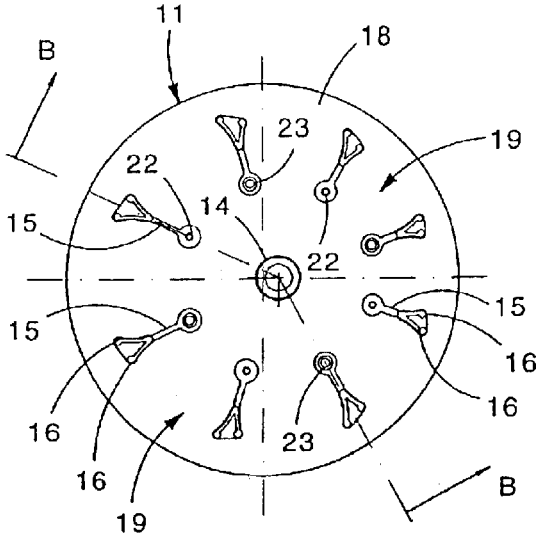
FIG. 5 is a view from above of FIG. 4.
Figure 6:
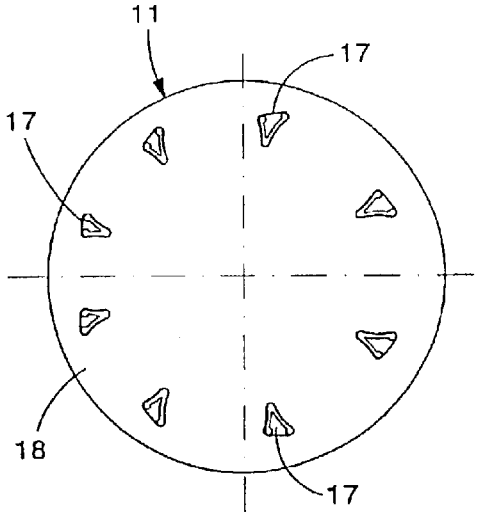
FIG. 6 is a view from below of FIG. 4.

The base 11 comprises a disk 18 on which, in this case in a single piece, a pin 14 is made, around which a plurality of dividing walls 15 are radially assembled, arranged equidistant therefrom and provided at the ends with a pair of elastic appendices 16 (FIGS. 4 and 5). The elastic appendices 16 are slightly raised with respect to the disk 18 which, below them, has apertures 17 which facilitate the flexibility of the elastic appendices 16 (FIG. 6).

Figure 7:
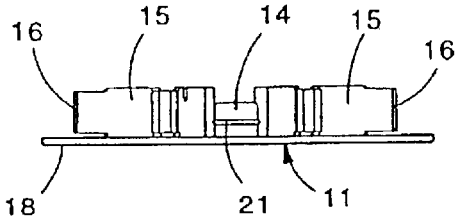
FIG. 7 is a side view of FIG. 4.
Figure 8:
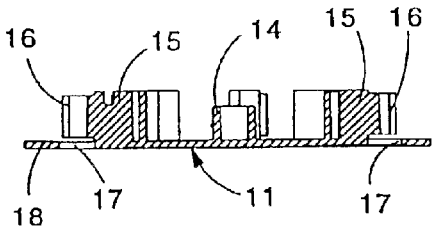
FIG. 8 shows a section from B to B of FIG. 5.
Figure 9:
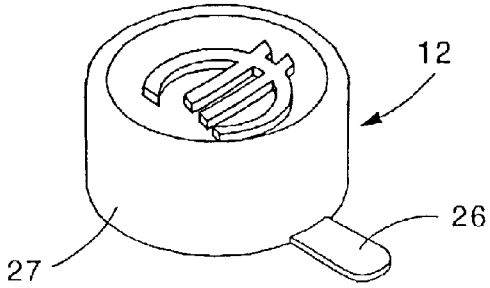
FIG. 9 is an axonometric projection of a second component of the container-dispenser shown in FIG. 1.
Figure 10:
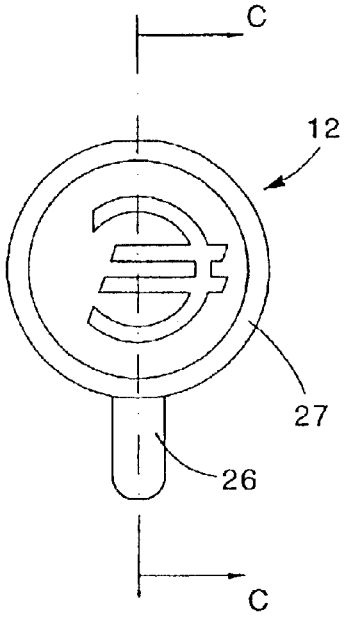
FIG. 10 is a view from above of FIG. 9.
Figure 11:
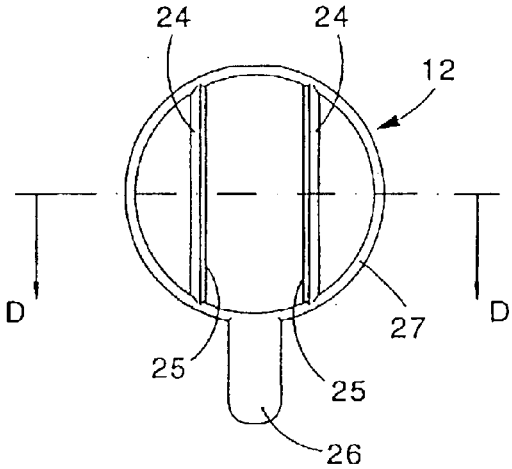
FIG. 11 is a view from below of FIG. 9.
Figure 12:
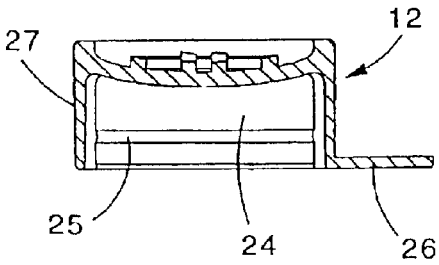
FIG. 12 shows a section from C to C of FIG. 10.
Figure 13:
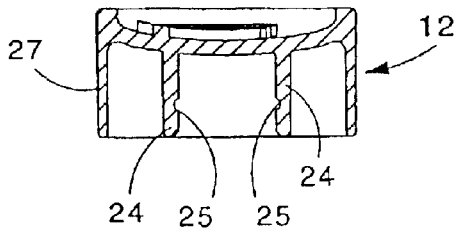
FIG. 13 shows a section from D to D of FIG. 11.
Figure 14:
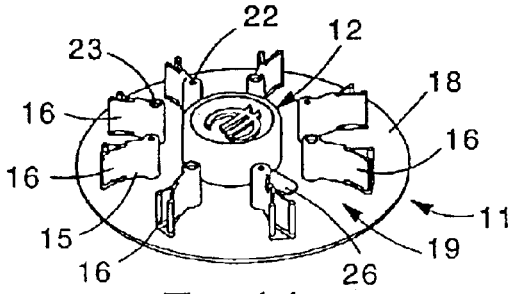
FIG. 14 is an axonometric projection of the container-dispenser shown in FIG. 1 in a partly assembled condition.

The pin 14 is associated with a ring 21 (FIG. 7) protruding with respect thereto, the function of which will described hereafter.

The dividing walls 15 define with the disk 18 a plurality of housing seatings 19, each suitable to accommodate coins 20 grouped together according to their value.

In each of the housing seatings 19 several coins 20 of the same value can be arranged, stacked one on top of the other between two adjacent dividing walls 15 and held in correspondence with their perimeter by the relative elastic appendices 16.

In the embodiment shown here, the pin 14 is made in an eccentric position with respect to the disk 18, so that the housing seatings 19 are of different dimensions and allow to hold coins 20 of various diameters.

In this case, there are eight housing seatings 19 in which all the coins of the Euro monetary system can be arranged.

At the end facing towards the pin 14, the dividing walls 15 have a larger zone on which first holes 22 and second holes 23 are alternately made. To be more exact, on each larger zone of the odd dividing walls 15 a first hole 22 is made, whereas on each larger zone of the even dividing walls 15 a second hole 23 is made, with a greater diameter than that of the first hole 22, or vice versa.

The knob 12 comprises a hollow cylindrical body 27 inside which there are two walls 24, parallel to each other and equipped with respective grooves 25. The knob 12 also has an expulsion tongue 26 protruding at the base of the cylindrical body 27 (FIGS. 9–12).

The knob 12 is assembled above the pin 14, which is arranged between the two walls 24 with its ring 21 snapped into the grooves 25; the expulsion tongue 26 is arranged slightly above the disk 18.

In this condition the knob 12, while remaining constrained to the pin 14, is free to rotate around the latter and to translate, making the pin 14 slide between the walls 24 inside the cylindrical body 27, to take the expulsion tongue 26 selectively inside a desired housing seating 19, as will be explained hereafter.

Figure 16:
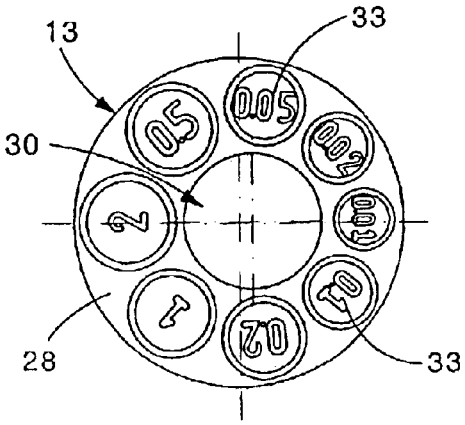
FIG. 16 is a view from above of a third component of the container-dispenser shown in FIG. 1.
Figure 17:
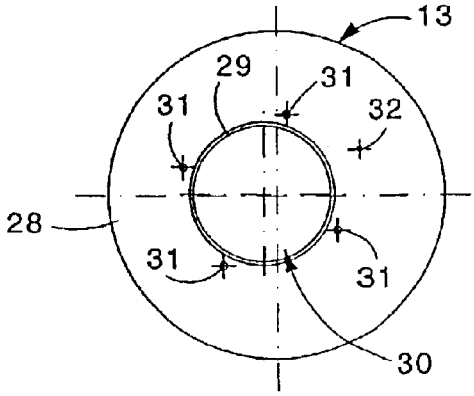
FIG. 17 is a view from below of FIG. 16.
Figure 18:
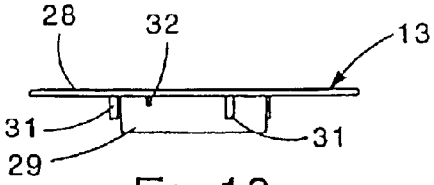
FIG. 18 is a side view of FIG. 16.

The lid 13 (FIGS. 16÷18) comprises a disk 28 with the same diameter as that of the disk 18 and associated at the upper part with the latter by means of four assembly pins 31 present on its lower face and inserted in four mating second holes 23 of the dividing walls 15. In this case there is also a reference pin 32 on the disk 28, which during assembly is inserted into one of the second holes 22 of the dividing walls 15 to determine the correct positioning and centering of the lid 13 with respect to the base 11.

There is also a through hole 30 on the disk 28, in this case circular and coaxial with the pin 14, through which it is possible to access the knob 12; on the lower face of the disk 28, substantially in correspondence with the circumference of the through aperture 30, there is a circular wall 29 raised with respect to the disk 18 of the base 11, so as to allow the expulsion tongue 26 of the knob 12 to pass below said wall 29.

On the upper face of the disk 28 there are the indications 33 of the values of the coins 20 which can be found, in an underlying position, in the relative housing seatings 19.

In this case, the indications 33 consist of numbers, made embossed and located inside a circumference, which refer to the values of the coins 20.

According to a variant, the numbers are printed on the disk 28.

According to another variant the disk 28, or the whole lid 13, are made of transparent material so as to make the coins 20 visible from above.

According to another variant, the indications 33 are made in embossed characters, for example Braille, for the visually impaired.

We shall now describe how the container-dispenser 10 according to the invention is used.

To insert the coins 20 into the relative housing seatings 19 it is enough to push the coins 20 from the outside towards the pin 14, so as to deform the elastic appendices 16 of the dividing walls 15 between which the coins 20 have to be inserted.

By doing this it is possible to fill all the housing seatings 19, stacking the coins 20 of the same value one on top of the other in each of the housing seatings 19, until all the space between the disk 18 of the base 11 and the disk 28 of the lid 13 has been used up.

Figure 15A:
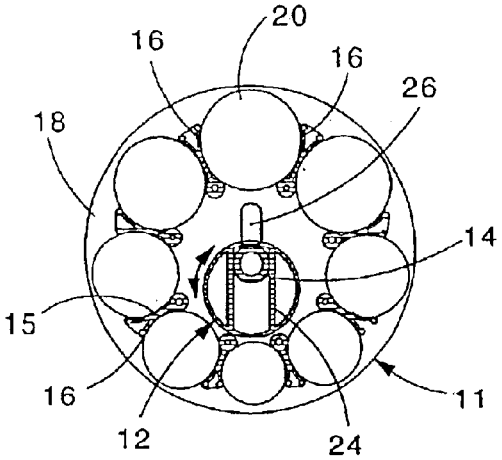
FIGS. 15*a* and 15*b* illustrate schematically the use of the container-dispenser according to the invention.

In this step the knob 12 is kept in a retracted position, with the expulsion tongue 26 in a position of non-interference with the housing seatings 19 (FIG. 15*a*).

To extract the coins 20 it is enough to rotate the knob 12 directing the expulsion tongue 26 towards the housing seating 19 relating to the coin 20 to be extracted, which can easily be identified by means of the indications 33.

Figure 15B:
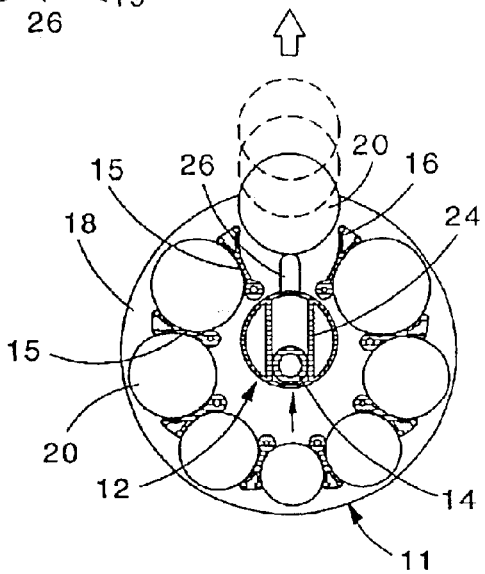

Subsequently, the knob 12 is moved towards the housing seating 19 so that the expulsion tongue 26 pushes the lowest coin 20 of the coins housed therein towards the outside, that is to say, the coin resting on the disk 18. By doing this, the coin 20 opens the elastic appendices 16 between which it is held, until it is expelled completely out of the housing seating 19 (FIG. 15*b*).

The knob 12 is then returned to the retracted position, so that the coins 20 previously located above the expelled coin fall onto the disk 18 of the base 11.

The operation can be repeated for all the coins 20 contained in the housing seatings 19, first rotating and then pushing the knob 12 in the direction of the desired housing seating 19.

It is clear that modifications and/or additions of parts can be made to the container-dispenser 10 as described heretofore without departing from the field and scope of the present invention.

For example, the lid 13 can be attached to the base 11 by means of gluing, ultra-sound welding, screwing, or other suitable system.

Or the pin 14, instead of being made in a single piece with the disk 18, can be an autonomous element attached during the assembly of the container-dispenser 10.

Furthermore, instead of the disks 18 and 28 it is possible to use flat elements of a shape other than circular, although this remains the preferential shape.

More generally, the container-dispenser 10 can also have an elongated shape and can have aligned housing seatings 19 accessible by moving the knob 12 longitudinally.

Moreover, it is clear that, although the invention has been described with reference to specific examples, a person of skill in the art shall certainly be able to achieve many other equivalent forms of container-dispenser for coins, all of which shall come within the field and scope of the present invention.

What is claimed is:

1. Container-dispenser for coins comprising a base on which a plurality of housing seatings are defined, each suitable to accommodate coins of a defined value, said base being associated with expulsion means able to be selectively positioned in correspondence with one at a time of said housing seatings to push and expel a relative coin, said housing seatings being defined by dividing walls including elastic appendixes able to cooperate with the perimeter of said coins, to hold them in said housing seatings, and to temporarily deform, when said coins are pushed by said expulsion means, to allow them to exit from the relative housing seating.

2. Container-dispenser as in claim 1, wherein a plurality of coins of the same value are able to be stacked one on top of the other in each of said housing seatings, and said expulsion means are able to act on the coin located lowest of said coins.

3. Container-dispenser as in claim 1, wherein said expulsion means are associated with knob means mounted in an off-center position on said base and that said housing seatings have different sizes to accommodate coins of different diameter.

4. Container-dispenser as in claim 3, wherein said knob means, are able to assume at least a first retracted position, wherein said expulsion means are in a position of non-interference with said housing seatings, and a second advanced position wherein said expulsion means move at least partly inside said housing seatings.

5. Container-dispenser as in claim 4, wherein said housing seatings are made in a circle around said knob means which are able to rotate, in order to position themselves in correspondence with each of said housing seatings, and to translate in order to move from said first position to said second position and vice versa.

6. Container-dispenser as in claim 5, wherein said knob means are associated with a pin integral with said base, with respect to which they are able to rotate and translate for a defined travel.

7. Container-dispenser as in claim 6, wherein said knob means comprise a hollow body including inside two parallel walls inside which said pin is constrained.

8. Container-dispenser as in claim 7, wherein said pin has a protruding ring cooperating with mating grooves made on said walls.

9. Container-dispenser as in claim 7, wherein said expulsion means comprise a tongue protruding from said body.

10. Container-dispenser as in claim 1, having a lid of a shape mating with that of said base and provided with an aperture giving access to said knob means.

11. Container-dispenser as in claim 10, wherein said aperture is a through aperture, and at a lower part said lid has at least a wall which develops around said through aperture and is raised with respect to said base to allow said expulsion means to pass below said wail and to be inserted in said housing seatings.

12. Container-dispenser as in claim 10, wherein at an upper part said lid has indications of the value of the coins able to be contained in the housing seatings below.

13. Container-dispenser as in claim 12, wherein said indications are embossed characters.

14. Container-dispenser as in claim 13, wherein said indications are characters for the visually impaired, of the Braille type or similar.

15. Container-dispenser as in claim 10, wherein said lid is of the transparent type.

16. Container-dispenser as in claim 10, wherein said lid is associated with said base by pin-type assembly means, present on a member selected from the group consisting of said lid and said base, able to be inserted in mating holes, made on another member selected from the group consisting of said base and said lid.

17. Container-dispenser as in claim 10, wherein said lid is associated with said base by means of gluing, ultra-sound welding or other suitable method.

* * * * *